US008850771B2

(12) United States Patent
Jenkins et al.

(10) Patent No.: US 8,850,771 B2
(45) Date of Patent: Oct. 7, 2014

(54) SYNTHETIC SHINGLE OR TILE WITH STRESS RELIEF SPACING FEATURE

(75) Inventors: Robert L. Jenkins, Honey Brook, PA (US); Gregory F. Jacobs, Oreland, PA (US); Husnu M. Kalkanoglu, Swarthmore, PA (US)

(73) Assignee: CertainTeed Corporation, Valley Forge, PA (US)

( * ) Notice: Subject to any disclaimer, the term of this patent is extended or adjusted under 35 U.S.C. 154(b) by 409 days.

(21) Appl. No.: 12/444,478

(22) PCT Filed: Oct. 24, 2007

(86) PCT No.: PCT/US2007/082338

§ 371 (c)(1),
(2), (4) Date: Jun. 25, 2009

(87) PCT Pub. No.: WO2008/052028

PCT Pub. Date: May 2, 2008

(65) Prior Publication Data

US 2010/0043331 A1 Feb. 25, 2010

Related U.S. Application Data

(60) Provisional application No. 60/862,877, filed on Oct. 25, 2006.

(51) Int. Cl.

| | |
|---|---|
| ***E04D 1/00*** | (2006.01) |
| ***E04D 1/36*** | (2006.01) |
| ***E04D 1/20*** | (2006.01) |
| ***E04D 1/08*** | (2006.01) |
| *E04D 1/12* | (2006.01) |

(52) U.S. Cl.
CPC *E04D 1/085* (2013.01); *E04D 1/36* (2013.01); *E04D 1/205* (2013.01)
USPC ..... 52/519; 52/98; 52/525

(58) Field of Classification Search
CPC ..... E04D 1/125; E04D 1/20; E04D 1/22; E04D 1/36; E04F 13/0864
USPC ..... 52/118, 98, 525, 519, 559
See application file for complete search history.

(56) References Cited

U.S. PATENT DOCUMENTS

| | | | | |
|---|---|---|---|---|
| 1,060,432 A * | 4/1913 | Canio | ..... | 52/519 |
| 1,558,795 A * | 10/1925 | Donahue | ..... | 52/523 |
| 1,595,080 A * | 8/1926 | Fischer | ..... | 52/526 |

(Continued)

OTHER PUBLICATIONS

Daniel Benn Atcheson, Roofing Construction and Estimating 1995, Craftsman book Company, pp. 110-112.*

*Primary Examiner* — Charles A Fox
*Assistant Examiner* — Joseph J Sadlon
(74) *Attorney, Agent, or Firm* — Paul & Paul

(57) ABSTRACT

Synthetic polymer based roofing elements of the shingle or tile type are provided whereby adjacent roofing elements have projecting tabs or nibs that are adapted to engage against side edges of adjacent shingles or tiles when laid up in courses on a roof, and wherein there are relatively flexible stress relief zones in the shingle or tile adjacent the tab or nib projections, adapted to be deformed within their elastic limit when the shingles or tiles are subjected to stresses due to thermal expansion and contraction, with the stress relief zones also being adapted to return to their original non-deformed condition when such thermal expansion and contraction forces are relieved.

10 Claims, 6 Drawing Sheets

(56) References Cited

U.S. PATENT DOCUMENTS

| | | | | | |
|---|---|---|---|---|---|
| 1,696,120 | A | * | 12/1928 | Hooker | 52/523 |
| 1,745,631 | A | * | 2/1930 | Mickelson | 52/559 |
| 1,795,277 | A | * | 3/1931 | Fischer | 52/526 |
| 2,390,348 | A | * | 12/1945 | Black | 52/526 |
| 4,366,197 | A | * | 12/1982 | Hanlon et al. | 428/43 |
| 4,476,661 | A | * | 10/1984 | Hoofe, III | 52/546 |
| 4,709,519 | A | * | 12/1987 | Liefer et al. | 52/98 |
| 5,307,604 | A | * | 5/1994 | Tasso | 52/745.19 |
| 5,615,523 | A | * | 4/1997 | Wells et al. | 52/98 |
| 5,630,305 | A | * | 5/1997 | Hlasnicek | 52/518 |
| 5,648,144 | A | * | 7/1997 | Maurer et al. | 428/141 |
| 5,857,303 | A | | 1/1999 | Beck et al. | |
| 5,946,877 | A | * | 9/1999 | Gallinat et al. | 52/543 |
| 6,021,611 | A | * | 2/2000 | Wells et al. | 52/98 |
| 6,134,856 | A | * | 10/2000 | Khan et al. | 52/536 |
| 6,213,707 | B1 | * | 4/2001 | Liehs et al. | 414/421 |
| 6,939,036 | B2 | | 9/2005 | Beck et al. | |
| 7,351,462 | B2 | * | 4/2008 | Friedman et al. | 428/68 |
| 7,631,461 | B2 | * | 12/2009 | Shadwell et al. | 52/98 |
| 7,934,346 | B2 | * | 5/2011 | MacKinnon et al. | 52/554 |
| 7,987,885 | B2 | * | 8/2011 | Zhou et al. | 156/433 |
| 8,225,567 | B1 | * | 7/2012 | Mollinger et al. | 52/302.4 |
| 2003/0093958 | A1 | * | 5/2003 | Freiborg et al. | 52/73 |
| 2004/0111996 | A1 | * | 6/2004 | Heroneme | 52/518 |
| 2004/0241476 | A1 | * | 12/2004 | Friedman et al. | 428/515 |
| 2005/0086907 | A1 | * | 4/2005 | Jolitz | 52/782.1 |
| 2005/0089672 | A1 | * | 4/2005 | Kuipers et al. | 428/156 |
| 2005/0262790 | A1 | * | 12/2005 | Turek | 52/518 |
| 2006/0029775 | A1 | | 2/2006 | MacKinnon et al. | |
| 2009/0260309 | A1 | * | 10/2009 | Humphreys et al. | 52/309.1 |
| 2012/0117908 | A1 | * | 5/2012 | Turek et al. | 52/519 |

* cited by examiner

SYNTHETIC SHINGLE OR TILE WITH STRESS RELIEF SPACING FEATURE

CROSS-REFERENCE TO RELATED APPLICATIONS

This application claims the priority from PCT/US07/82338 filed Oct. 24, 2007 which in turn claims the priority of U.S. Ser. No. 60/862,877 filed Oct. 25, 2006.

BACKGROUND OF THE INVENTION

Polymeric synthetic shingles or tiles, such as, for example, synthetic slate and shake materials can have a significant amount of thermal expansion and contraction when in use on a roof, due to variations in temperature conditions. It is important in installation to space adjacent shingles or tiles on a roof sufficiently close to each other so that gaps are not formed in the roof's protective covering, and sufficiently far apart so, that when the shingles expand and contract through temperature cycling, the shingles are not dislodged from the roof by such movement.

Such thermal expansion and contraction can lead to forces imposed on the edges of the roofing products where adjacent roofing products are abutted. In some instances, the forces may be large enough so that over repeated temperature changes during use, the shingle or tile fasteners may become dislodged from the roof, or the movement of the shingle or tile may lead to the development of stress cracking near contact points and cause damage to the shingle body.

Some shingle or tile products have integral spacers, called "nibs" along their side edges, that engage side edges of ad adjacent shingles or tiles to properly space adjacent products so that there is uniform spacing from shingle-to-shingle or from tile-to-tile, within a given course of shingles or tiles, as well as from course-to-course.

Some composite such products have their nibs hollowed out. Such shingles can be of generally solid construction except for the hollows inside the spacing nibs, where some material has been removed so that if the nib is pushed toward the body of the shingle or tile, there is potential for some give of the nib itself. The material from which the shingles or tiles are constructed can be sufficiently frangible that such "give" may cause the shingles or tiles to break.

Synthetic shake look panels typically have a locking arrangement where a portion of the panels overlap and slide by one another with expansion and contraction, along with a spacing gauge so that the panels are properly spaced at an installation temperature.

U.S. Pat. No. 6,939,036 discloses an installation method for a roof covering component, comprising providing first and second building components, one of said components being characterized by a predetermined expansion characteristic whereby said roofing component expands and contracts with temperature, said predetermined expansion characteristic causing a variation in distance between a reference point and a comparison point on the roofing component. The method can include determining a current temperature of the roofing component during one of installation and testing, by measuring said current temperature using a temperature sensor that is integral and affixed to at least one of said building components; equating the current temperature to a distance between the reference point and the comparison point at said current temperature; and assessing a position of the comparison point relative to the reference point for accommodating the expansion characteristic during subsequent changes in said current temperature.

THE PRESENT INVENTION

This invention is a synthetic roofing shingle or tile having a spacing feature that includes a stress relieving structure. The invention is also a method of relieving stress near a spacing feature of a synthetic building material and a method of making a synthetic roofing shingle having a stress relieving spacing feature. The invention is also applicable to shingles or tiles that comprise large panels that are larger than conventional-sized shingles or tile.

SUMMARY OF THE INVENTION

This invention is a synthetic roofing shingle or tile having a spacing feature that includes a stress relieving structure nearby. The structure acts as a spring to allow local movement in the product as loading forces are encountered over time. Forces of thermal expansion and contraction are dissipated by the stress relief zones of the invention and movement of the product is accommodated without dislodgement of fasteners. The stress relieving zones of the invention provide an energy absorbing feature near spacing tabs or nibs. The zones can facilitate force dissipation between shingles or tiles by providing a crumple zone that can deform and release mechanical energy without dislodgement or other damage to the shingles or tiles. This spacing feature also facilitates initial positioning of adjacent shingles or tiles in aesthetically pleasing configuration and accommodates dimensional changes that may occur over time without dislocation of the shingles or tiles.

BRIEF DESCRIPTIONS OF THE DRAWING FIGURES

DETAILED DESCRIPTIONS OF THE PREFERRED EMBODIMENTS

It will be understood that, as used throughout this specification, the words "shingle", and "tile" are used interchangeably, and in some cases are referred to as "slate", or "synthetic slate", or "synthetic shake", all intended to be without limitation. Also, as used throughout herein, the term "nailing zone" is intended to apply in the broadest sense, to include any type of fastening zone, whether it be for a nail, staple or the like. Because roofing products have conventionally been applied via nails, the zones of the shingles or tiles through which fasteners are applied have conventionally become referred to as "nail zones", although it will be understood that any type of suitable fastener may be used, and will fall within the scope of "nail zone" or "nailing zone" as used herein. When a stress relief zone is described herein as acting spring-like or "stretching" within its elastic limit, such means that, after applied stresses are removed, the stretched stress relief zone will return to its unstretched, original configuration or shape.

Figures 1, 2:
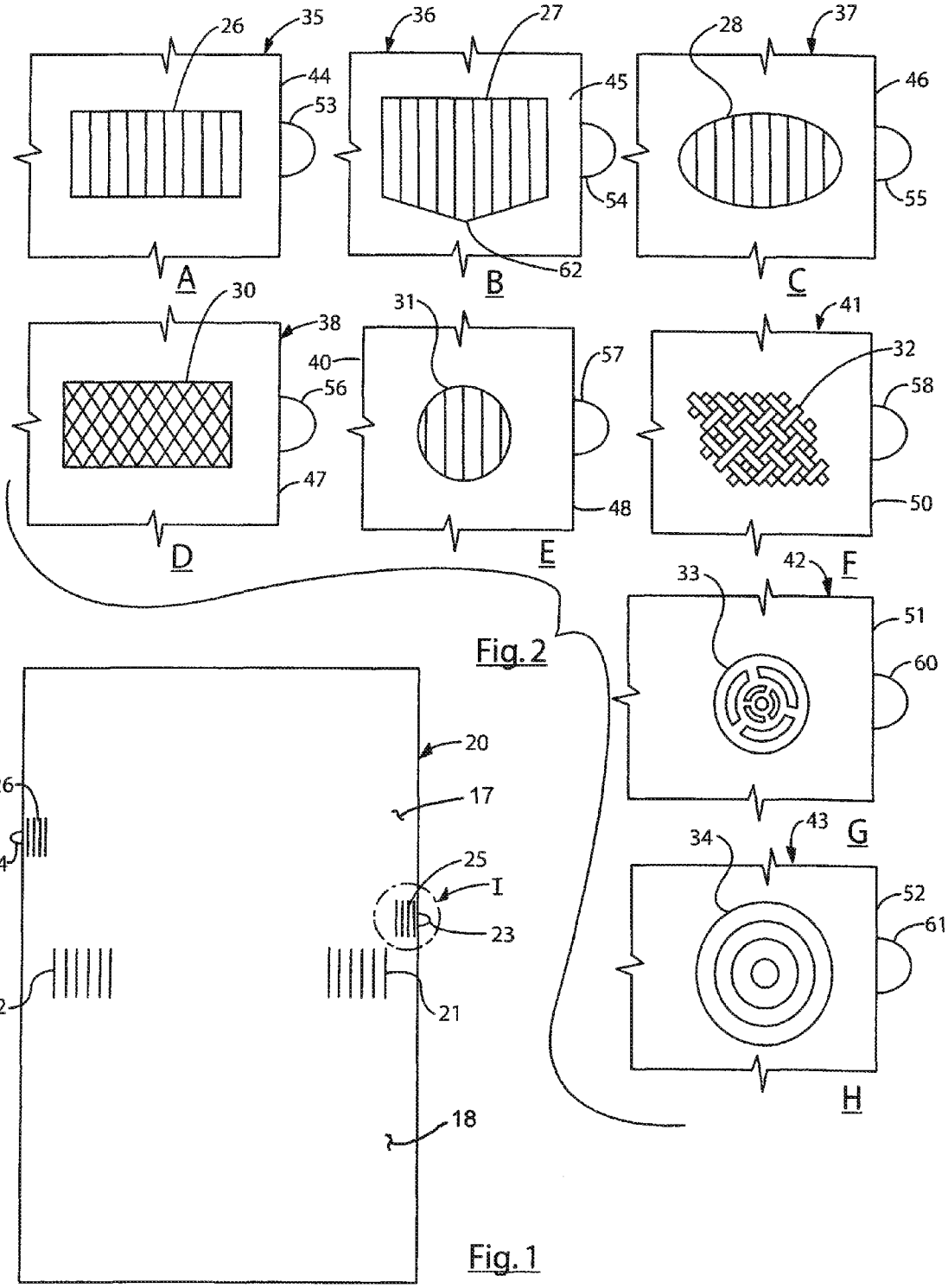
FIG. 1 is a top plan view of a synthetic shingle or tile product in the form of a synthetic slate, with nail zones and spacing features, each spacing feature having an associated stress relieving, zone as shown, for example, in detail I at the right side thereof.
FIG. 2 shows fragmentary illustrations of top plan views of shingle or tiles of the FIG. 1 type, with spacing nibs and other configurations for stress relieving zones 2A through 2H inside the right edges of the shingles or tiles adjacent the spacing nibs.

FIG. 1 shows a shingle or tile 20, preferably of the synthetic slate type, with nail zones 21, 22 and spacing features 23, 24 of the tab or nib type, each spacing feature having an associated stress relieving zone 25, 26. The stress relief zones 25, 26 are adjacent to spacing tabs or nibs 23, 24. When shingles or tiles 20 are placed adjacent to one another on a roof surface, the tabs serve to space the main bodies of the shingles so that when they undergo potential thermal expansion, they do not buckle and cause damage or displacement to occur. When the shingles or tiles 20 are abutted tightly to one another, with the spacing features 23, 24 in contact with a side edge of an adjacent shingle or tile, the stress relief zones or features 25, 26 take up some of the load through spring-like deformation so that stresses do not build up that could negatively affect the performance of the roof. The deformation of the stress relief zones 25, 26 may be fully reversible, as is preferable, or may be partly reversible. In some instances, the deformation may be permanent. The stress relief zones 25, 26 can be formed in either the top or bottom of the shingle or tile, or in both the top and bottom of the shingle or tile.

The roofing element 20 has a headlap portion 17 being adapted to have its top surface generally covered in the installed condition of the element on a roof and tab portion 18 being adapted to have its top surface generally uncovered and weather-exposed in the installed condition of the element on a roof. The nailing zones 21, 22 are in the headlap portion.

In FIG. 2, a variety of stress relieving zones 26, 27, 28, 30, 31, 32, 33 and 34 in shingles or tiles 35, 36, 37, 38, 40, 41, 42 and 43, respectively of FIGS. 2A through 2H are depicted, having various configurations of ripples or surface texture inside a side edge 44, 45, 46, 47, 48, 50, 51 and 52, adjacent respectively associated tabs or nibs 53, 54, 55, 56, 57, 58, 60 and 61. The stress relieving zones can take on various shapes. FIG. 2B, for example, shows a shape 27 that could have a drainage point 62 for the zone if the structure is included on the top surface of the shingle or tile. The shape of the structure can include thickness variations or can include undulations or shapes of similar or different thicknesses to effect a spring-like force dissipater in the stress relief zone any of the shape can have lateral or horizontal components to its design. It can also include radial components. In the case where thickness is varied in the nail zone, there can be regions of very thin material, and there can even be portions of the stress relief zone where there are passages passing through the plane of the shingle or tile. In cases where the structure does not involve full penetration of the shingle or tile plane, the stress relief structures can be formed in the top, the bottom, or on or in both the top and bottom surfaces of the shingles or tiles.

Figure 3:
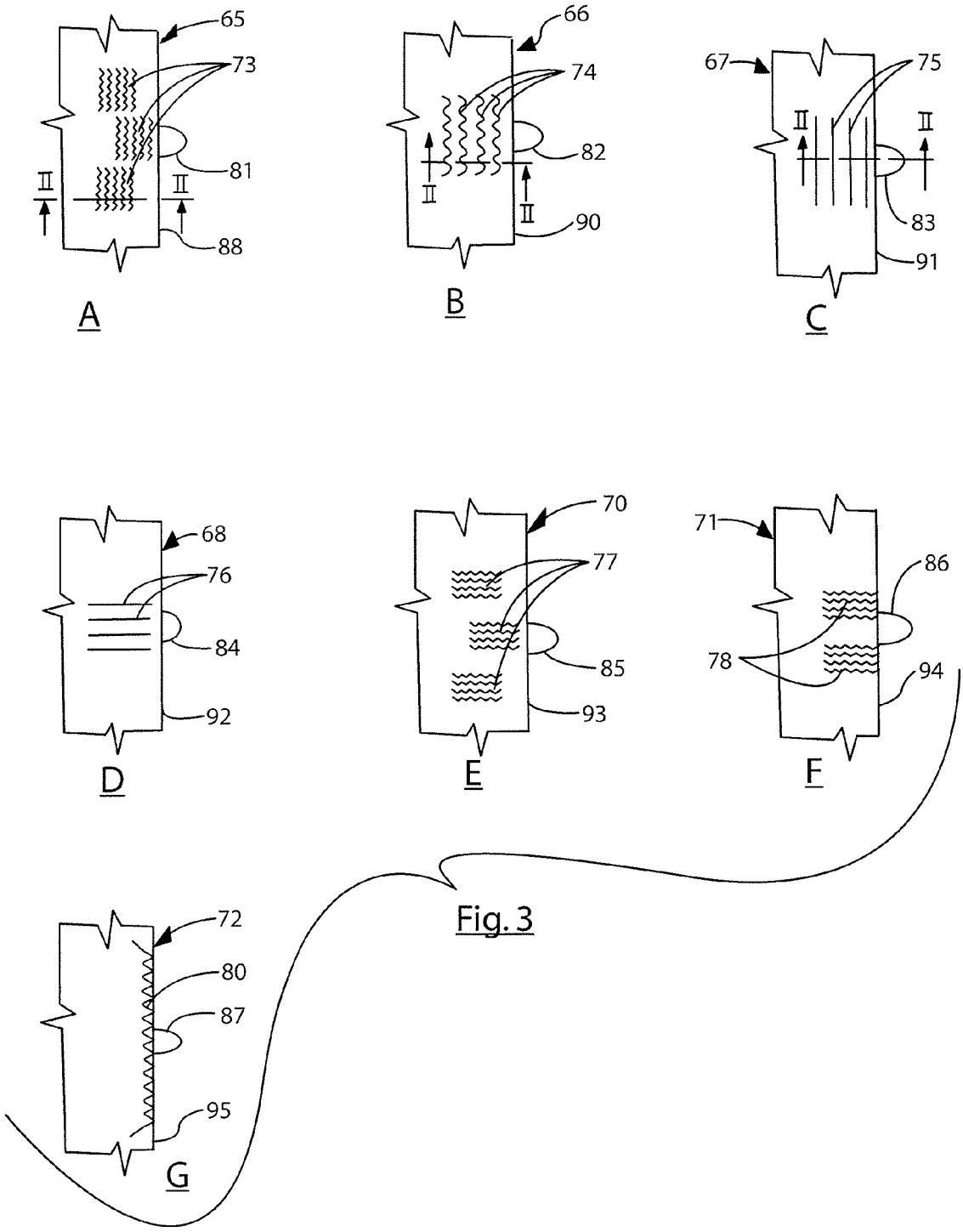
FIG. 3 shows fragmentary illustrations of top plan views of shingles or tiles of the FIG. 1 type, with spacing nibs and other configurations for stress relieving zones 3A through 3G inside the right edges of the shingle or tile adjacent the spacing nibs.
Figure 4:
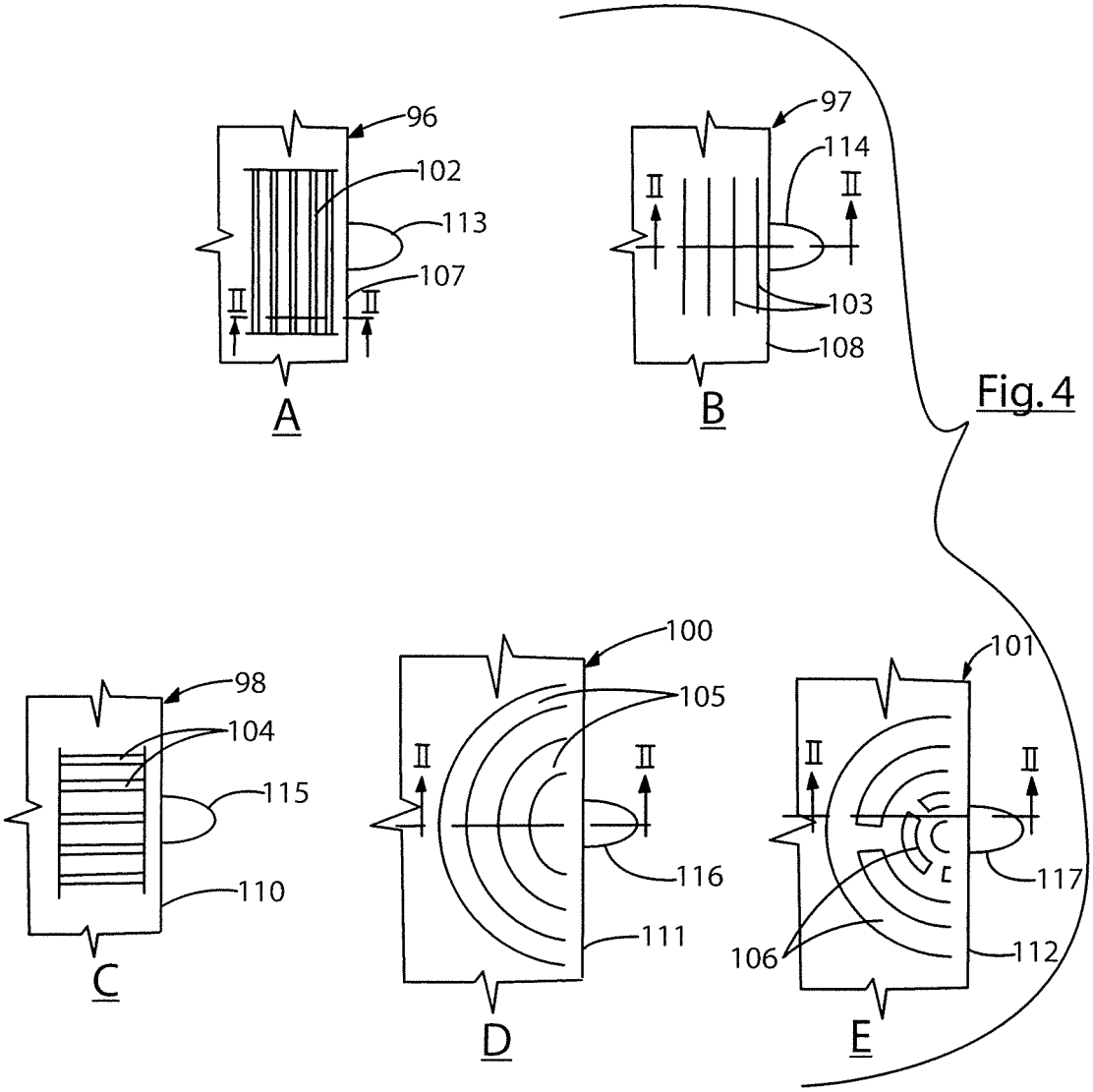
FIG. 4 shows fragmentary illustrations of top plan views of shingles or tiles of the FIG. 1 type, with spacing nibs and other configurations for stress relieving zones 4A through 4E inside the right edges of the shingle or tile adjacent the spacing nibs.

With reference to FIG. 3, it will be seen that the fragmentary illustrations of the shingles or tiles 65, 66, 67, 68, 70, 71 and 72 of FIGS. 3A through 3G, respectively, are provided with their respectively associated stress relieve zone configurations 73, 74, 75, 76, 77, 78 and 80 just inside of, and adjacent to the projecting tabs or nibs 81, 82, 83, 84, 85, 86 and 87 that extend from right side edges 88, 90, 91, 92, 93, 94, and 95. The lines associated with the stress relief zones indicate thickness variations in different arrangements that will allow for movement of the material comprising the stress relief zones when the shingle or tile is loaded laterally by contact with an adjacent shingle, such that the affected tab or nib will be forced inwardly of its associated side edge, such that the adjacent stress relief zone can absorb the stress forces by acting in a spring-like manner or as a "crumple" zone as is illustrated hereinafter.

FIG. 4A through 4E show fragmentary illustrations of other shingles or tiles 96, 97, 98, 100 and 101 with their accompanying stress relief zones 102, 103, 104, 105 and 106, respectively inside right edges 107, 108, 110, 111 and 112, adjacent to respectively associated projecting tabs or nibs 113, 114, 115, 116 and 117, as shown. The lines of these stress relief zones indicate undulations in thickness especially with respect to FIG. 4A. All such lines for FIGS. 4 through 4E indicate thickness variations in different arrangements to allow for movement of the material when the shingle or tile is loaded laterally by contact with an adjacent shingle in the vicinity of the nibs or tabs, in a manner similar to the description above for the various configurations of FIG. 3.

FIG. 4C illustrates an arrangement where the stress relief zone 104 is rotated approximately 90 degrees relative to the configuration of FIG. 4A. FIGS. 4D and 4E illustrate radial configurations, although FIG. 4E illustrates some additional support in its stress relief zone 106.

Figure 5:
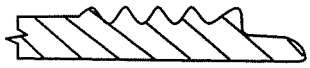
FIGS. 5 and 6 show transverse sectional views of different spacing feature and stress relieving zone configurations, taken generally along line II-II of FIGS. 3C, 4B, 4D and 4E, for example.
Figure 6:
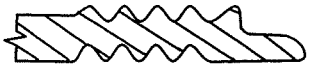
Figure 7:
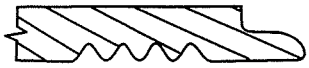
FIG. 7 shows a transverse sectional view of another embodiment of a stress relief zone near a spacing feature.

With reference now to FIGS. 5, 6 and 7, such are various cross-sectional illustrations, taken through various ones of the shingles or tiles illustrated in FIGS. 3A, 3B and 3C and through FIGS. 4A, 4B, 4D and 4E, for example, wherein the stress relief zones of any of these shingles or tiles are shown to have corrugations or undulations in either the top surface as shown in FIG. 5, the bottom surface as shown in FIG. 7, or both top and bottom surfaces as shown in FIG. 6, in each case just inboard of the tab or nib shown at the right side of said shingle or tile, all as shown in FIGS. 5-7. Such corrugations or undulations illustrate variations in texture, and in any of FIGS. 3A, 3B, 3C, 4A, 4B, 4D and 4E, can be understood as having been taken generally along line II-II of any of said figures. The stress relief zones of any of the sub-illustrations of FIGS. 3 and 4 can involve variations in thickness, that may or may not include very thin regions with little connecting material, and, in some cases can involve perforations through the shingle body.

Figure 8:
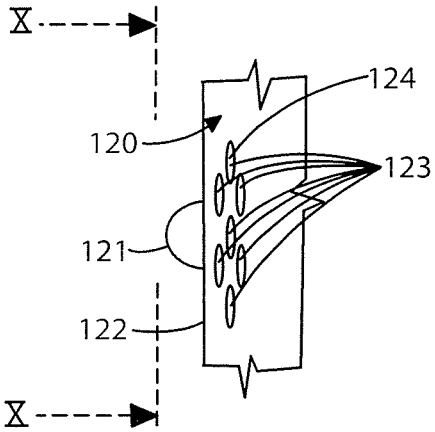
FIG. 8 illustrates a fragmentary top plan view of a shingle or tile in accordance with this invention, having a spacing nib along the left edge thereof, with a stress relief zone in the shingle or tile adjacent the nib.
Figure 10:
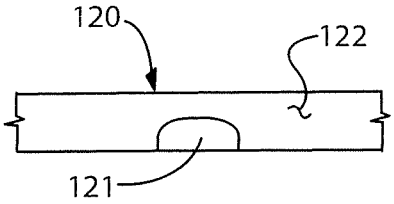
FIG. 10 is a left side elevational view of the fragmentary shingle or tile of FIG. 8, taken generally along the line X-X of FIG. 8.

With reference to FIGS. 8 and 10, it will be seen that a shingle or tile 120, having a tab or nib 121 projecting from the left side 122 of the shingle or tile 120, is located just outward of a stress relief zone 124 comprised of a plurality of oval perforations 123 that are passages through the entire shingle or tile 120. In another embodiment, some or all of the features 123 may be closed.

Figure 9:
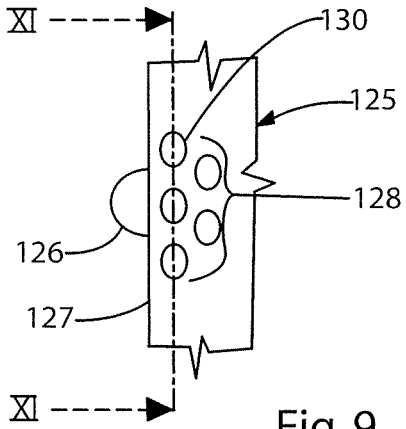
FIG. 9 is a fragmentary top plan view of a shingle or tile in accordance with this invention, having a spacing nib along the left edge thereof, with an alternative stress relief zone in the shingle or tile adjacent the nib.
Figure 11:
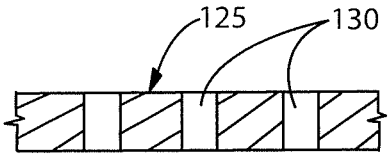
FIG. 11 is a fragmentary sectional view taken through the stress relief zone of FIG. 9, generally along the line XI-XI of FIG. 9.

With reference to FIGS. 9 and 11, it will be seen that the shingle or tile 125 has a tab or nib 126 projecting leftward of the left side edge 127, and as can be seen along line XI-XI, for example, the stress relief zone 128 that is located just inboard of the tab or nib 126 is comprised of a plurality of individual more rounded ovals 130, or circular perforations through the body of the shingle or tile 125. Other arrangements than those shown in FIGS. 8 and 9 are also possible, and have the potential, like those of FIGS. 8 and 9, for more efficient material usage in the manufacture of the shingle. In some embodiments some or all of the features 130 may be closed.

Figure 12:
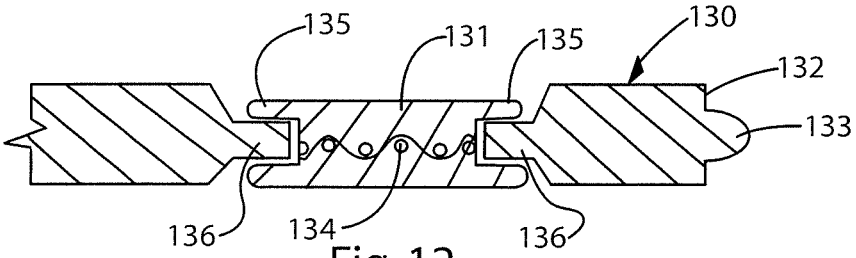
FIG. 12 is a fragmentary sectional view taken through a shingle or tile in accordance with this invention, wherein the stress relief zone is of an alternative, grommet-like configuration.

With reference to FIG. 12, another shingle or tile 130 is illustrated in section, having a stress relief zone 131 located inboard of the right side edge 132 of the shingle or tile, adjacent the projecting tab or nib 133. The stress relief zone 131 may be comprised of a grommet-like structure, as shown, generally comprised of a softer, more flexible, elastomeric or rubber-like material that may or may not have a supporting web 134 contained therein, with the zone 131 having portions 135 engaged in a form of locking arrangement against radial inward projection portions 136 of the shingle or tile 130, as shown, such that the relatively flexible stress relief zone 131 is capable of lateral movement relative to the relatively rigid shingle or tile 130 in which it is disposed. The relatively flexible zone 131 may alternatively be adhesively secured to the remainder of the shingle or tile 130, or vulcanized or heat sealed thereto, or otherwise inserted therein in the manner of a grommet, as shown. Such an arrangement will also allow for upward or downward movement as may be desired. In the event of a web-like or other reinforcement 134, such can provide strength in the stress relief zone 131.

Figure 12A:
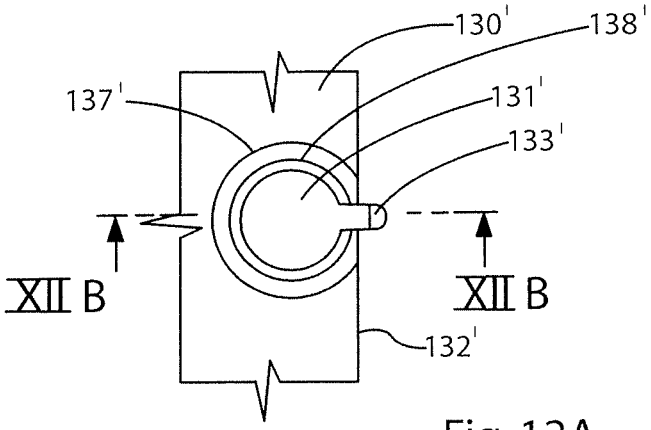
FIG. 12A is a top plan view of a fragmentary portion of a shingle or tile in accordance with this invention, wherein the spacing nib is present in a grommet-like configuration applied to the shingle or tile.
Figure 12B:
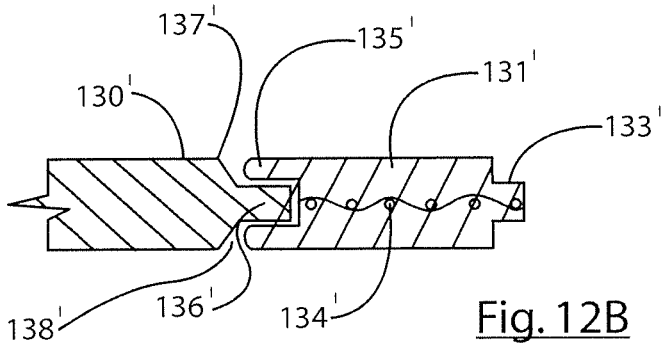
FIG. 12B is a slightly enlarged, fragmentary sectional view taken through the shingle or tile of FIG. 12A, generally along the line XIIB-XIIB of FIG. 12A.

With reference now to FIGS. 12A and 12B, it will be seen that the shingle or tile 130' has placed therein, a grommet-like configuration 131', having a projecting tab or nib 133', projecting rightwardly, as shown in FIG. 12A, from the edge 132' of the shingle or tile 130'. The projection or nib 133' is disposed rightwardly of the main portion of the grommet-like configuration 131'. The leftmost side of the grommet-like portion 131', most particularly, as shown in FIG. 12B, has leftwardly extending fork-like portions 135' that engage on both sides of the portion 136' of the shingle or tile 130'. The grommet-like portion 131' has a reinforcement 134', preferably of the fabric type. In the embodiment shown, the shingle or tile 130' is of reduced thickness as shown by the partial circular configurations 137' and 138', to yield the portion 136'.

For molded spring-type stress relief zones, a preferred thickness is about ⅓ of the thickness of the slate-like or other synthetic shingle or tile, including for example a shake tile, although such can be somewhat thinner or thicker as desired. For molded spring-type stress relief zones, with or without through passages, the preferred frequency of the pattern across the stress relief zone is approximately 5-15 lines per inch, with a more preferred frequency of about 10 lines per inch.

With reference now to FIGS. 3-15, it will now be demonstrated how adjacent shingles or tiles 140, 141 in accordance with this invention, when laid up on a roof 139 (fragmentally illustrated) may react when subjected to thermal expansion and contraction under conditions of variations in temperature, for example or if shingles or tiles are forcibly applied in a configuration closer than intended by a manufacturer's recommendations. It will be seen that the adjacent shingles or tiles 140, 141 are spaced apart an amount "D", as originally applied to a roof, with their respective projecting tabs or nibs 142, 143 defining a spacing "D" therebetween for their respective right and left side edges 144, 145, with the nib or tab 142 of shingle or tile 140 just touching the left edge 145 of the shingle or tile 141, and with the nib or tab 143 of the shingle or tile 141 just touching the right edge 144 of the shingle or tile 140. It will also be seen that the shingles or tiles 140, 141 have respective stress relief zones 146, 147, just adjacent to their respectively associated tabs or nibs 142, 143.

Figure 14:
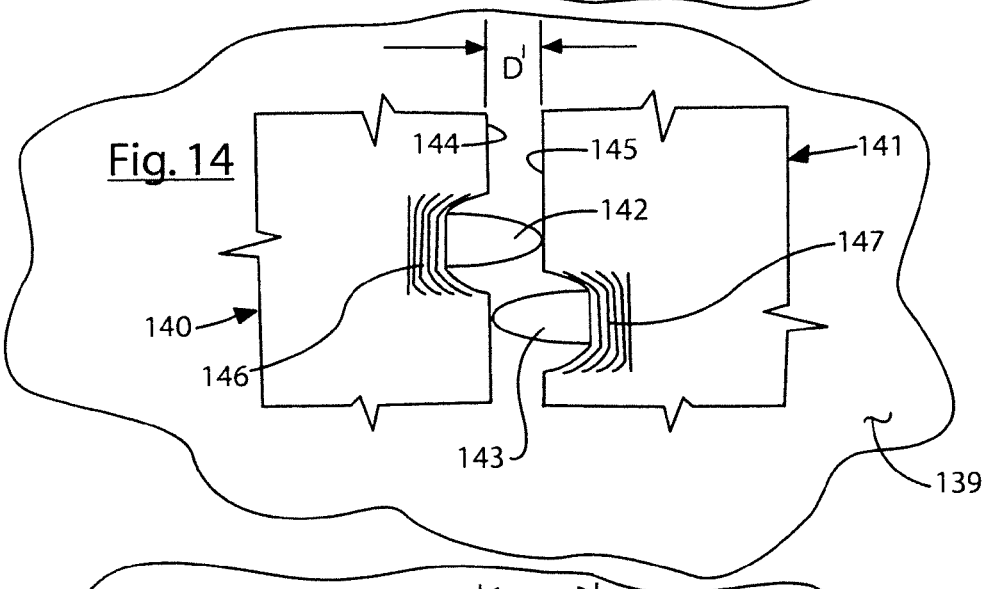
FIG. 14 is an illustration like that of FIG. 13, but wherein further expansion of the shingles or tiles causes them to move closer together than in the illustration of FIG. 13, and wherein the stress relief zones adjacent the associated nibs are caused to compress within their elastic limits.

With reference now to FIG. 14, it will now be seen that the shingles or tiles 140, 141, when subjected a forcible misalignment during initial installation or higher temperatures, such as during summer conditions when exposed on a roof 139, can expand, moving together laterally, such that their facing side edges 144, 145 move more closely together, as demonstrated by an amount D', such that their respectively associated nibs or tabs 142, 143, pressing against opposite side edges 145, 144 cause the stress relief zones 146, 147, to collapse, as shown in FIG. 14, preferably on a temporary basis, and within their elastic limits, to absorb the stresses imposed upon the nibs or tabs 142, 143, in order to prevent cracking or breakage of the shingles 140, 141, at those locations where the stress zones 146, 147 exist. Thus, the stress zones 146, 147 act in a spring-like manner.

Figure 13:
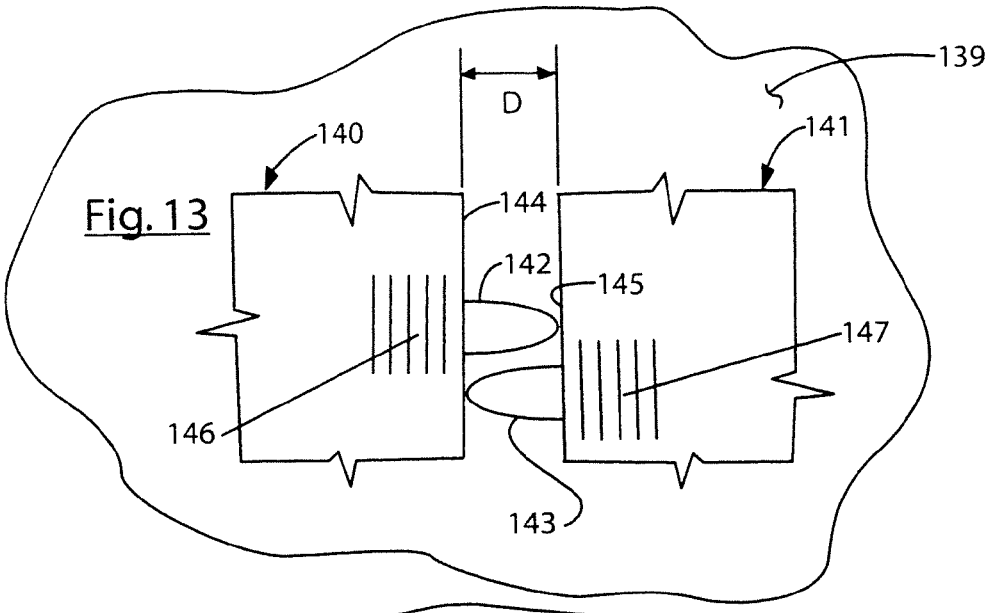
FIG. 13 is a top plan view of fragmentary portions of adjacent shingles or tiles as they would appear in the same course on a roof when laid up on a roof, such that spacing nibs are in touching engagement with side edges of shingles or tiles.
Figure 15:
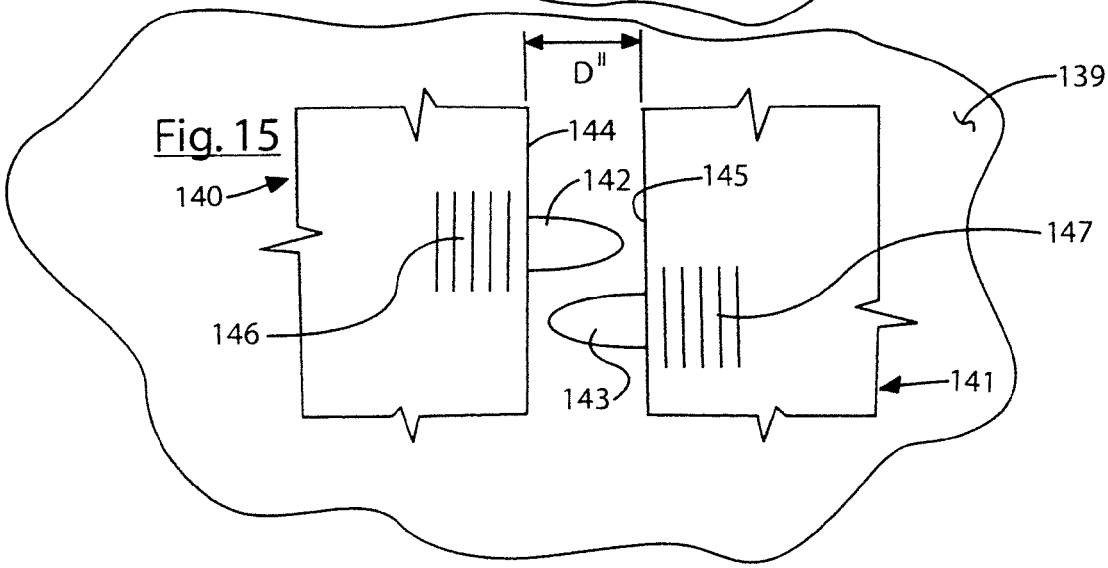
FIG. 15 is an illustration similar to that of FIGS. 13 and 14, but wherein contraction of the adjacent shingles or tiles cause them to become more widely spaced apart, so that nibs of adjacent shingles or tiles are no longer in engagement against side edges of next adjacent shingles or tiles.

With reference now to FIG. 15, it will be seen that, as the shingles or tiles 140, 141 are subjected to contraction forces, they may move away from each, as shown in FIG. 15, such that they are more widely spaced apart an amount D", as shown, such that their adjacent side edges 144, 145, are more widely spaced apart and whereby the stress relief zones 146, 147, acting in a spring-like manner, in each case, return to their original configurations as shown in FIG. 13, due to their inherent resilience.

In the case of molded spring type stress relief zones, a preferred thickness is about ⅓ of the thickness of the synthetic slate or shake shingle or tile, although it could be somewhat thinner or thicker. For molded spring type stress relief zones, the preferred frequency of the pattern across the nail zone is approximately 5 to 15 lines per inch with a more preferred frequency of about 10 lines per inch for the stress relieving spring pattern. Synthetic shingles employing the stress relief zones of the invention may be based on polymeric materials and can be comprised of multiple layers of different materials as may be desired. Preferred polymeric materials are thermoplastic materials, but thermoset materials could also be used. In some such shingles, recycled polymer content may be employed. Examples of suitable polymeric materials would include, but not be limited to, polyethylene material, a polypropylene, a polymethylpentene, a polybutene, a polyacrylate, a polyvinylchloride, or blends of various synthetic polymers, all as may be desired. Such synthetic shingles or tiles could also be comprised of ceramic materials or fiber cement materials (ie, cement-like materials having fibers therein). The polymeric or other materials may comprise not only the nail zones of shingles or tiles, but the shingles or tiles themselves. In some instances, where shingles or tiles are made of fiber cement, ceramic, metal or wood, the nail zones could be comprised of polymeric materials. Exemplary shingles using such stress relief zones may be made using processes as described in U.S. 2006/0029775. Appropriate mold fixtures or inserts could be employed to form the stress relief zones.

The stress relief zones as described in the figures hereof can be constructed of the same relatively rigid (like slate or tile) synthetic shingle or tile material as is the rest of the shingle or tile, or can be constructed of softer relatively flexible, more rubber-like materials that are adhesively secured to the remainder of the synthetic shingles, vulcanized thereto, or otherwise inserted therein in the manner of a grommet or the like as shown in FIG. 12 in a relatively rigid shingle body, such as will allow for movement, as may be desired. Such stress relief zones can optionally also include a webbing or like embedded reinforcement of strands or the like, to provide reinforcement.

As used herein, "relatively flexible construction" is defined as a structure that is capable of being fully or partially recoverable to its initial configuration once the applied stresses are removed.

It should now be appreciated that the practice of the present invention provides for a spacing feature and a method of forming a spacing feature that may serve as a stress relieving means or local support for a relatively rigid shingle, shake, tile or the like that is intended to be placed onto the exterior of a building structure or roof. It will be appreciated by those skilled in the art that changes and modifications may be made to the above described embodiments without departing from the inventive concept thereof. It is understood, therefore, that the present invention is not limited to particular embodiments disclosed, but is intended to include all modifications and changes which are within the scope and spirit of the invention as defined in the appended claims.

What is claimed is:

1. A synthetic roofing element of a shingle or tile type comprising:

(a) a headlap portion and a tab portion, each having top and bottom surfaces;

(b) the headlap portion and the tab portion each extending between their respective top and bottom surfaces;

(c) the headlap portion being adapted to have its top surface generally covered in the installed condition of the element on a roof, and the tab portion being adapted to have its top surface generally uncovered and weather-exposed in the installed condition of the element on a roof;

(d) the element having a periphery defined by upper, lower, right and left edges with the right and left edges having generally straight, linear edge portions;

(e) the element being essentially comprised of a relatively rigid construction;

(f) at least one spacing projection disposed adjacent to said headlap portion on at least one of said generally straight, linear left and right edge portions; and (g) at least one stress relieving zone in the headlap portion disposed inside one of the generally straight, linear left and right edge portions of the element periphery and adjacent to said at least one spacing projection;

(i) wherein at least a portion of the at least one stress relieving zone being comprised of a relatively flexible construction, relative to said relatively rigid construction;

(ii) whereby said relatively flexible construction comprises means for relieving forces acting upon any of said left edge and right edges due to thermal expansion and contraction, and without breakage, when a plurality of said elements are installed side-by-side in fastened engagement with a roof;

(h) wherein said at least one stress relieving zone includes means for expansion and contraction within the elastic limit of the material of which it is comprised and (i) each stress relieving zone being comprised of a plurality of perforations, with at least some of the plurality of the perforations being openings spaced entirely inside one of the generally straight, linear left and right edge portions of the element periphery, extending between and connecting top and bottom surfaces of the headlap portion, and with none of the stress relieving zones being in the tab portion of the roofing element.

2. The roofing element of claim 1, wherein the element is any one of:

(a) polymer based;

(b) fiber cement based;

(c) ceramic based; and (d) metal based.

3. The roofing element of claim 2, wherein the element is polymer based.

4. A roof covering comprising a plurality of successive courses of synthetic roofing elements of a shingle or tile type according to claim 1, the elements of each course being laid side-by-side and fastened to a roof with fasteners, each course being offset from the adjacent course or courses by a distance less than the length between upper and lower edges of any shingle.

5. The roof covering of claim 4, wherein the element is any one of:

(a) polymer based;

(b) fiber cement based;

(c) ceramic based; and (d) metal based.

6. The roof covering of claim 5, wherein the element is polymer based.

7. A method of relieving stresses near spacing projections on sides of headlap portions of relatively rigid synthetic roofing elements of shingles or tiles according to claim 1 comprising:

laying up a plurality of the elements on a roof, in overlying and underlying courses with tab portions of elements in overlying courses overlying headlap portions of elements in underlying courses, with elements being laid up side-by-side, in fastened engagement with the roof with spacing projections of the elements in engagement with adjacent elements; and relieving stress forces acting upon said elements from thermal expansion and contraction of the elements by deformation of the stress relieving zones of the elements; and wherein the stress relieving zones are deformed within the elastic limit of the material of which it is comprised.

8. The method of claim 7, wherein the disposing of the stress relieving zones comprises molding the stress relieving zones into the elements.

9. The method of claim 7, wherein the elements are any one of:

(a) polymer based;

(b) fiber cement based;

(c) ceramic based; and (d) metal based.

10. The method of claim 9, wherein the elements are polymer based.

* * * * *